US008516638B2

(12) United States Patent
Kummerfeld et al.

(10) Patent No.: US 8,516,638 B2
(45) **Date of Patent: *Aug. 27, 2013**

(54) FEEDING PILLOW WITH REMOVABLE SUPPORT SURFACE

(71) Applicant: The Boppy Company, LLC, Golden, CO (US)

(72) Inventors: Jamie Kummerfeld, Wheatridge, CO (US); Paul Fair, Denver, CO (US); Haley Gibbons, Wheatridge, CO (US); Clarice Bonzer, Littleton, CO (US)

(73) Assignee: The Boppy Company, LLC, Golden, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/675,058

(22) Filed: Nov. 13, 2012

(65) Prior Publication Data

US 2013/0125314 A1 May 23, 2013

Related U.S. Application Data

(63) Continuation of application No. 13/525,131, filed on Jun. 15, 2012, now Pat. No. 8,321,977.

(60) Provisional application No. 61/553,371, filed on Oct. 31, 2011.

(51) Int. Cl.
*A47C 20/00* (2006.01)

(52) U.S. Cl.
USPC ..... 5/636; 5/485; 5/490; 5/630; 248/118; 248/346.06; 297/219.1; 297/220

(58) Field of Classification Search
USPC ..... 248/346.01, 346, 2, 346.03, 346.06, 248/118; 5/636, 655, 630, 485, 639, 640, 5/643, 646, 648, 652, 657, 490; 297/219.1, 297/219, 220, 250.1, 221, 227, 391, 397, 297/411.2
See application file for complete search history.

(56) References Cited

U.S. PATENT DOCUMENTS

| | | | | |
|---|---|---|---|---|
| 4,066,072 | A | | 1/1978 | Cummins |
| 4,165,125 | A | * | 8/1979 | Owen ..... 297/220 |
| 4,321,718 | A | | 3/1982 | Chern |
| 4,731,890 | A | | 3/1988 | Roberts |
| 4,862,535 | A | | 9/1989 | Roberts |
| 4,895,327 | A | | 1/1990 | Malone et al. |
| D309,068 | S | | 7/1990 | Jordan et al. |
| 4,980,937 | A | | 1/1991 | Mason et al. |
| D315,845 | S | | 4/1991 | Lafley |
| D318,202 | S | | 7/1991 | Weber |
| 5,029,351 | A | | 7/1991 | Weber |
| D318,969 | S | | 8/1991 | Byrn |

(Continued)

*Primary Examiner* — Tan Le
(74) *Attorney, Agent, or Firm* — Kilpatrick Townsend & Stockton LLP

(57) ABSTRACT

A feeding pillow is constructed of a pillow body that is generally defined by a medial region and two opposing arms. The medial region is configured to be placed near or adjacent a user's stomach, with the arms generally near or adjacent the user's sides. The pillow body has a top surface that is adapted to hold a baby and a bottom surface that is adapted to be placed on the user's lap. The pillow body further includes a fabric cover and a fill material disposed within the fabric cover. Also, a support member is removably positioned at or above one of surfaces such that one surface is more firm than the other surface.

18 Claims, 10 Drawing Sheets

(56) References Cited

U.S. PATENT DOCUMENTS 5,086,529 A 2/1992 DeGroot
5,092,005 A 3/1992 Byrn
5,095,567 A 3/1992 Kenoyer
5,109,557 A 5/1992 Koy et al.
5,133,085 A 7/1992 de Pasquale Amicarelli et al.
5,133,098 A 7/1992 Weber
5,154,649 A 10/1992 Pender
5,193,238 A 3/1993 Clute
5,239,717 A 8/1993 Sue
5,261,133 A 11/1993 Wilkerson
5,261,134 A 11/1993 Matthews
5,272,780 A 12/1993 Clute
5,357,642 A 10/1994 Clute
5,367,730 A 11/1994 Sher
D353,494 S 12/1994 Beger
D369,054 S 4/1996 Straub et al.
D369,934 S 5/1996 Straub et al.
5,519,906 A 5/1996 Fanto-Chan
5,522,104 A 6/1996 Little
5,534,014 A 7/1996 Demeritt et al.
5,535,468 A 7/1996 Mallernee
5,546,620 A 8/1996 Matthews
5,551,108 A 9/1996 Butler, III
5,551,109 A 9/1996 Tingley et al.
5,581,833 A 12/1996 Zenoff
5,661,861 A 9/1997 Matthews
5,664,828 A 9/1997 Simon
5,675,852 A 10/1997 Watkins
5,675,853 A 10/1997 Linge
D389,359 S 1/1998 Nowak
5,709,000 A 1/1998 Hansen et al.
5,715,535 A 2/1998 Hamilton et al.
5,790,999 A * 8/1998 Clark ..... 5/655
5,826,287 A 10/1998 Tandrup
D408,676 S 4/1999 Straub et al.
5,930,854 A 8/1999 O'Neill et al.
5,937,461 A 8/1999 Dombrowski et al.
D413,751 S 9/1999 Alyea
5,947,427 A 9/1999 Holmquist
6,000,761 A 12/1999 Rocha
6,038,720 A 3/2000 Matthews et al.
6,055,687 A 5/2000 Matthews
6,061,854 A * 5/2000 Crowley ..... 5/655
6,079,067 A 6/2000 Becker et al.
6,112,748 A 9/2000 Esdale et al.
D432,846 S 10/2000 Parker et al.
6,189,169 B1 2/2001 Marcotte
D443,461 S 6/2001 Hall et al.
D444,981 S 7/2001 Hall et al.
6,279,185 B1 8/2001 Matthews
D450,516 S 11/2001 Darling et al.
D450,517 S 11/2001 Darling et al.
6,321,403 B1 11/2001 Matthews
6,354,665 B1 3/2002 Ross
6,381,786 B1 5/2002 Cadden
6,381,787 B1 5/2002 Rogone et al.
6,412,128 B1 7/2002 Matthews
6,434,770 B2 8/2002 Matthews Brown
6,453,493 B1 9/2002 Matthews Brown
6,484,337 B1 11/2002 Moe et al.
6,499,165 B1 12/2002 Morgillo
6,523,793 B1 2/2003 Higgins
6,532,612 B2 3/2003 Matthews Brown
6,536,057 B2 3/2003 Fennell et al.
6,539,567 B1 4/2003 Bae
6,553,590 B1 4/2003 Leach
6,564,408 B2 5/2003 Van Vuuren
6,574,810 B2 6/2003 Mangiaracina
6,625,828 B2 9/2003 Matthews Brown
6,640,977 B2 11/2003 Matthews Brown et al.
6,651,282 B1 11/2003 Skoug et al.
6,658,681 B2 12/2003 Britto et al.
6,671,908 B2 1/2004 Matthews Brown et al.
6,685,024 B1 2/2004 Matthews
6,708,354 B1 3/2004 Carter et al.
6,711,770 B1 3/2004 Owens et al.
6,745,399 B1 6/2004 Austin
6,754,924 B1 6/2004 Brady et al.
6,763,539 B1 7/2004 Bartley et al.
6,779,211 B1 8/2004 Williams
6,810,545 B1 11/2004 Darling et al.
6,842,925 B1 1/2005 Owens et al.
6,851,143 B2 2/2005 Matthews Brown
6,857,150 B2 2/2005 Matthews Brown et al.
D503,062 S 3/2005 Nash
6,877,176 B2 4/2005 Houghteling
6,918,148 B2 7/2005 Auxilia
6,918,149 B2 7/2005 Gowaty
6,944,898 B2 9/2005 Matthews Brown
6,954,942 B2 10/2005 Austin
7,000,274 B2 * 2/2006 Matthews Brown et al. ..... 5/636
7,000,275 B2 2/2006 Matthews Brown
7,000,766 B2 2/2006 Matthews Brown et al.
7,010,821 B1 3/2006 Leach
7,017,212 B2 3/2006 Matthews Brown
7,055,196 B2 6/2006 Littlehorn
7,059,000 B2 6/2006 Verbovszky
7,080,810 B2 7/2006 Munjed
7,089,639 B2 8/2006 Brown et al.
7,108,646 B1 9/2006 Quick
7,111,347 B1 9/2006 Cottrell
7,127,760 B2 10/2006 Bartley et al.
7,131,156 B1 11/2006 Walker-Craft
7,146,663 B2 * 12/2006 Brown et al. ..... 5/636
7,290,303 B2 11/2007 Mead et al.
7,322,061 B2 1/2008 Carroll
7,331,073 B2 2/2008 Littlehorn et al.
D567,562 S 4/2008 Nash
7,356,861 B1 4/2008 Pagano
D571,596 S 6/2008 Alvistur et al.
7,386,902 B2 6/2008 Wilson
7,404,222 B2 7/2008 Tidwell
D578,818 S 10/2008 Margalit
D579,256 S 10/2008 Alfieri et al.
7,430,774 B2 10/2008 Littlehorn et al.
7,451,508 B2 11/2008 Brown et al.
7,464,423 B2 12/2008 Goodwin et al.
7,472,443 B2 1/2009 Littlehorn et al.
7,478,867 B2 1/2009 Weng
7,513,001 B1 4/2009 Leach
D593,787 S 6/2009 Dafna
7,540,049 B2 6/2009 Gagliano et al.
7,547,071 B2 6/2009 Huffman
7,562,406 B1 7/2009 Leach
7,587,773 B2 9/2009 Littlehorn et al.
7,624,461 B2 12/2009 Tidwell et al.
7,640,598 B1 1/2010 Mallik
7,657,955 B1 2/2010 Alvistur et al.
7,676,871 B1 3/2010 Leach
7,682,324 B2 3/2010 Pillari
7,703,159 B2 4/2010 Parrilla
7,712,169 B2 5/2010 Kovalyak
7,752,692 B1 7/2010 Sanders et al.
D624,344 S 9/2010 Kashey
7,788,752 B2 * 9/2010 Tidwell et al. ..... 5/655
D624,777 S 10/2010 Pepys
7,810,191 B2 10/2010 Littlehorn et al.
7,832,036 B2 11/2010 Littlehorn et al.
7,886,381 B2 2/2011 Aiken et al.
7,900,303 B2 3/2011 Mastrosimone-Gese
7,926,135 B1 4/2011 Leach
8,321,977 B1 * 12/2012 Kummerfeld et al. ..... 5/636
2001/0044968 A1 11/2001 Schmitter et al.
2002/0146673 A1 10/2002 Aranas
2004/0075318 A1 4/2004 Wroobel
2004/0130194 A1 7/2004 Wroobel
2005/0225137 A1 * 10/2005 Mead et al. ..... 297/250.1
2006/0075563 A1 4/2006 Bartner et al.
2006/0179574 A1 8/2006 Margalit
2006/0260057 A1 11/2006 Dunn et al.
2006/0265809 A1 11/2006 Wagner
2007/0056110 A1 3/2007 Tuoriniemi et al.
2007/0056111 A1 3/2007 Lastman
2007/0186346 A1 8/2007 Jensen

| | | | |
|---|---|---|---|
| 2007/0246492 | A1 | 10/2007 | Carpentieri |
| 2008/0010750 | A1 | 1/2008 | Tidwell |
| 2008/0141462 | A1 | 6/2008 | Woods |
| 2009/0007335 | A1 | 1/2009 | Tidwell |
| 2009/0199343 | A1 | 8/2009 | Collins |
| 2010/0117431 | A1 | 5/2010 | Huffman |
| 2011/0023236 | A1 | 2/2011 | Sanders et al. |
| 2011/0119833 | A1 | 5/2011 | Clark |
| 2011/0173755 | A1 | 7/2011 | Whittaker |
| 2012/0073058 | A1 | 3/2012 | Sclare et al. |

* cited by examiner

FEEDING PILLOW WITH REMOVABLE SUPPORT SURFACE

CROSS REFERENCES TO RELATED APPLICATIONS

This application is a continuation of U.S. patent application Ser. No. 13/525,131, filed Jun. 15, 2012, which is a non-provisional application claiming the benefit of U.S. Provisional Patent Application No. 61/553,371, filed Oct. 31, 2011, the complete disclosure of which is herein incorporated by reference.

BACKGROUND OF THE INVENTION

This invention relates generally to the field of pillows. In particular, the invention relates to nursing and feeding pillows. In some embodiments, such pillows axe provided with various attachments to facilitate positioning of a baby on the pillow.

Over the years, a variety of support pillows have found commercial acceptance. One exemplary support pillow is the Boppy® pillow, marketed by The Boppy Company. Various forms of this pillow are described in U.S. Pat. Nos. 5,261,134, 5,546,620, 5,661,861, and 6,055,687, among others. The complete disclosures of these patents are incorporated herein by reference.

One particular use of support pillows is to facilitate feeding and nursing. This invention relates to ways to enhance the use of various embodiments of nursing and feeding pillows.

BRIEF SUMMARY OF THE INVENTION

In one embodiment, the application describes a feeding pillow having a pillow body that is generally defined by a medial region and two opposing arms that extend from the medial region. The medial region is configured to be placed near or adjacent a user's stomach, with the arms generally near or adjacent the user's sides. Also, the pillow body has a top surface that is adapted to support a baby and a bottom surface that is adapted to be placed on the user's lap, although it will be appreciated that the pillow could be flipped over and used in the opposite manner. The pillow body comprises a fabric cover and a fill material disposed within the fabric cover. A support member is removably coupled to the pillow body at or above the top (or bottom) surface.

In one aspect, the support member has a firmness that is different than a firmness of the pillow body. For example, the support member may have a firmness that is greater than that of the pillow body. Such a relatively firm support member may be particularly useful in orienting a baby when positioned on the pillow, such as when a mother is nursing the baby. However, in some cases, the firmness of the support member could be less than that of the pillow body.

In another aspect, the support member covers a majority of the medial region at the top surface. This configuration is particularly useful when a baby is laid atop the pillow. In some cases, the support member may cover substantially all of the medial region at the top surface.

For convenience of description, the support member may be defined in terms of a top surface, a bottom surface, a distal side and a proximal side. In one aspect, the top surface generally angles downward from the distal side to the proximal side. This helps to position the baby against the mother, and is particularly useful when nursing the baby.

The pillow body may include a pocket at the top surface. The pocket defines an enclosure into which the support member is removably received. In this way, the support member may be removed simply by slipping it out of the pocket. In one aspect, the pocket is sewn about an outer periphery of the pillow body. The pocket may also define an opening, and a zipper may be used to close the opening. This opening may be located at or near the outer periphery, the inner periphery (adjacent the well region), along one of the arms, across the top of the pillow, and the like.

In one particular configuration, the medial region of the pillow body has a length in the range from about 14 inches to about 26 inches and a width in the range from about 6 inches to about 16 inches. Each of the arms may have a length in the range from about 6 inches to about 20 inches, and a width in the range from about 4 inches to about 8 inches to define a stomach receiving region with a width of about 7 inches to about 18 inches. Also, the support member may have a length in the range from about 15 inches to about 25 inches, a width in the range from about 5 inches to about 15 inches, a height at the distal side in the range from about 2 inches to about 5 inches, and a height at the proximal side in the range from about 0.25 inches to about 2 inches to define an angle of inclination in the range from about 20 degrees to about 35 degrees.

In one particular arrangement, the support member may further comprise reduced sized arms or rounded projections that are shorter than the arms of the pillow body. The support member may also include a contoured upper surface so as to define an elevated distal edge and a recessed center region. The support member may be constructed of a variety of materials to provide the appropriate firmness, including materials such as an open cell foam, a closed cell foam, a gel material, visco-elastic materials, inflatable bladders, and the like.

Optionally, a belt may be removably attached to the arms. For example, a pair of buckle clips may be used to removably attach the belt to the pillow body.

In another embodiment, the invention provides an exemplary method for supporting an object on the lap of a sitting user. According to the method, a support pillow is placed on a user's lap. The support pillow comprises a pillow body generally defined by a medial region and two opposing arms that extend from the medial region, and the medial region is placed near or adjacent the user's stomach, with the arms generally near or adjacent the user's sides. The pillow body also has a top surface and a bottom surface that is placed on the user's lap. The pillow body comprises a fabric cover and a fill material disposed within the fabric cover, and the support pillow further comprises a support member removably coupled to the pillow body at or above the top surface. With this arrangement, an object is placed onto the support pillow so as to rest on the support member.

In one aspect of the method, the support member has a firmness that is greater than a firmness of the pillow body, and the support member has a top surface, a bottom surface, a distal side and a proximal side. Also, the top surface of the support member generally angles downward from the distal side to the proximal side. Further, the object is a baby who, when placed on the pillow, angles toward the user's chest when resting on the support surface. In this way, the mother may more easily nurse the baby. If needed, the pillow may be secured about the user's waist using a belt.

In a further aspect, the support pillow further comprises a pocket at the top surface of the pillow body. The pocket defines an enclosure into which the support member is removably received. This allows the support member to be removed from the pocket. Such a configuration permits the support member to be replaced with a different support member, such as one with a different geometry and/or firmness. This also provides the benefit of allowing the pillow to be washed in washing machine after removing the support member.

In another embodiment, the invention provides a feeding pillow that is constructed of a pillow body that is generally defined by a medial region and two opposing arms. The medial region is configured to be placed near or adjacent a user's stomach, with the arms generally near or adjacent the user's sides. The pillow body has a top surface that is adapted to hold a baby and a bottom surface that is adapted to be placed on the user's lap. The pillow body further includes a fabric cover and a fill material disposed within the fabric cover. Also, a support member is positioned at or near the top surface or the bottom surface such that one of the surfaces is more firm than the other surface. In this way, a user has the option of choosing which surface to hold the baby and which surface to place on the user's lap. As one specific example, a mother may choose to have a more firm surface for holding a baby while the bottom surface, that rests on the user's lap, is more plush and pliable. However, it will be appreciated that depending on the size and body shape of the user, or the size and body shape of the baby, the user may prefer to have the firmer side up or to have the softer side up.

In one aspect, the support member comprises a layer of dense foam material. In some cases, the foam layer may be sewn or otherwise connected to the fabric cover. In one option, the foam layer includes a depression such that the top surface includes a recessed region that is adapted to hold a baby.

DETAILED DESCRIPTION OF THE INVENTION

Figure 1:
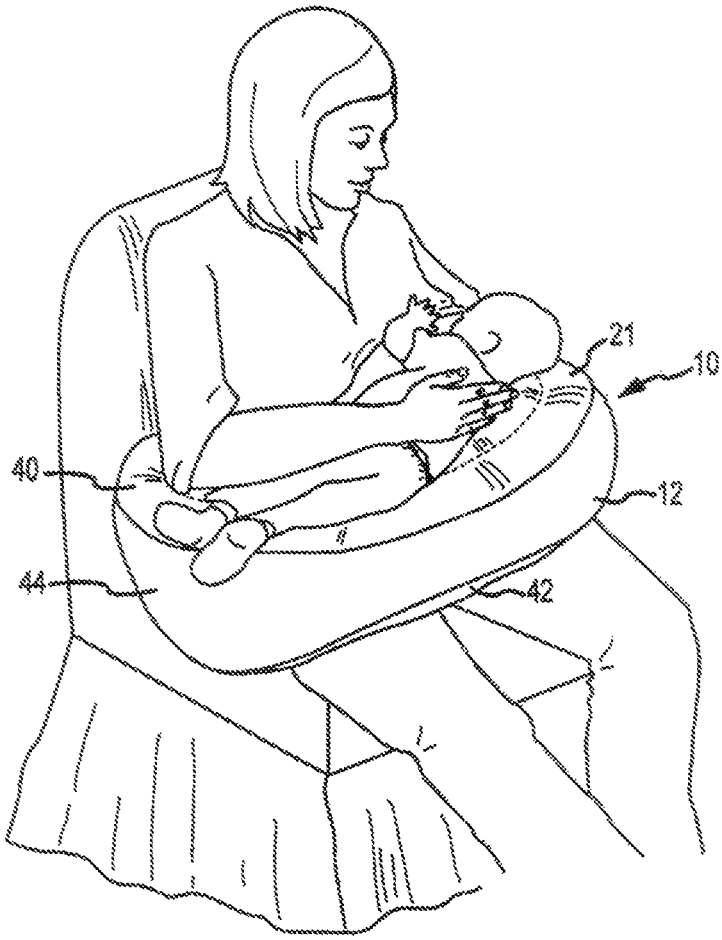
FIG. 1 illustrates the use of one embodiment of a feeding pillow when feeding a baby.

The invention provides various pillows that may be used in a variety of ways, usually in association with the care of a baby. Merely by way of example, the pillows of the invention may be used to assist with nursing or feeding a baby. In a typical use, the pillow will be placed on a user's lap, with the baby resting on a top surface of the pillow.

In one particular arrangement, the pillows may be constructed of a medial region and two side arms that are widely spaced-apart from each other so that the pillow may be placed about the waist and/or stomach of an adult. In some cases, the arms may be somewhat flexible to permit the arms to be further separated or distanced from each other. The arms may be somewhat resilient so that if spread and released, they spring back to their original position. This permits the pillow to be placed about large objects, with the arms tensioned against the object, yet not uncomfortably. For example, when the ends of the pillow arms are separated enough to be placed about the torso of an average sized adult, the inward force produced by each arm is sufficient to hold the pillow in place about the torso, yet not so tight that it is uncomfortable. Further, when the pillow clings about a relatively large object, the medial region does not buckle, but keeps its shape. When removed, the pillow's resilience permits it to spring back to its original shape. In some cases, the arms may be sufficiently separated in their normal position such that they can be easily placed about a user's waist without the need to separate the arms. Such an arrangement is particularly useful when the pillow is placed on a user's lap and a baby is positioned on top of the pillow. Optionally, a belt that is coupled to the arms may be used to hold the pillow in place.

In one important aspect, the pillow has a top surface and a bottom surface. The top surface is used to support a baby while being held by the mother, caregiver, or the like, while the bottom surface is designed to rest on the user's lap. The bottom surface may be constructed to be somewhat firm, yet can have some "give" when resting on a user's lap. As such, the top surface may be more firm than the bottom surface. This helps to ensure that the user will feel comfortable when the pillow is resting on her lap. However, it will be appreciated that the softer surface could also be used to hold the baby while the firmer surface rests on the user's legs. This may depend on a variety of factors, including the mother's preference, the size and body shape of the mother or the baby, and the like.

As previously mentioned, the top surface which holds the baby may be configured in some embodiments to be more firm than the lower surface. This provides increased support to the baby. Also, the top surface may be configured as a removable insert or support surface. This permits a pillow with a uniform firmness to have a firmer surface by utilizing the more firm insert or support surface.

To construct the pillow, a cover or shell is used to surround a fill material. In one embodiment, the fill material may completely fill the interior except near the top surface of the pillow where a layer of dense foam may be provided to increase the stiffness and rigidity of the pillow at the top surface. In some cases, such as where a firm insert or removable support member is used, the entire pillow body may be filled with the fill material, with the added firmness being provided by the insert. Examples of foam materials that may be used to provide the increased firmness at the top surface include polyurethane foams, neoprene, latex, memory foams and the like. The fill material used to make the pillow may be such that the pillow is relatively firm when filled, particularly so that the pillow will not significantly deflect under the weight of a baby. Examples of materials that may be used include polyester fibers, foamed materials, and the like. One method for filling the cover with a fill material is described in U.S. Pat. No. 7,089,639, which is incorporated herein by reference.

The cover may be constructed of a top and bottom main portion using one or more pieces of fabric and a center and/or side panel(s) at the inner periphery and/or sides of the pillow. In some cases, the overall shape of the pillow may be similar to those described in U.S. Pat. Nos. 5,261,134, 5,661,861, 5,546,620 and 6,055,687; 6,685,024; 6,434,770; 6,671,908; 7,017,212; 6,279,185; 6,412,128; 7,451,508; 7,127,760; 6,944,898; 7,587,773; 7,472,443; 7,404,222; 7,430,774; 7,832,036; 7,788,752; 6,038,720; 6,763,539; and U.S. patent application Ser. No. 13/071,358, filed Mar. 24, 2001 and entitled "Travel Nursing Pillow," incorporated herein by reference. One particularly useful geometry is a U-shape with a medial region and shortened arms. The medial region is sized to extend across the user's stomach and be gently curved. The arms are spaced apart so as to extend along the user's sides without buckling of the pillow. The medial region is also wide enough to hold a baby while feeding. The main portion of the cover or shell may, in some cases, be constructed of two or more pieces of material which are sewn to each other, with the center and/or side panel(s) being sewn to the main portion, although other coupling techniques may be used, such as by using a fabric glue. Some techniques for attaching a center panel of material to a cover are also described in U.S. Pat. No. 6,412,128 and U.S. Patent Publication No. 2008/0010750, which are incorporated herein by reference. The material used to construct the main portion(s) of the cover and/or the center and/or side panel(s) may be a fabric, such as cotton, polyester, velvet, cotton/poly blends and the like. Such fabrics permit the pillow to be firmly stuffed with fill materials. When stuffed in this manner, the pillows are able to maintain their shape for extended time periods. Such fabrics also provide an aesthetically pleasing surface.

The support pillows of the invention may find use with a variety of applications where the arms are placed around or adjacent an object. Merely by way of example, such applications may include placement about a torso to facilitate nursing or feeding or an infant, the holding of an object, such as a book, a toy, food, or the like.

The stiffening layer or member used at or near the top surface may conveniently be sewn or otherwise attached to the cover at the top surface. In some cases, a separate stiffening member could be attached to the pillow body in a manner similar to a "pillow top" mattress. Further, in some cases, a stiffening member could be removably attached to the top surface similar to a "topper" used on mattresses.

In one embodiment, increased firmness at the top surface may be obtained by using a separate support member having a firmness that is greater than the resilient fill material that is used to construct the pillow body. The support member may be configured to be removably attached to the pillow body. Making the support member removable from the pillow body provides a number of advantages including: the ability to remove the support member when washing the pillow (such as in a conventional washing machine), replacing the support member with one of a different size, shape and/or firmness, the ability to use the pillow without the firmer surface, and the like.

The support member may be removably attached to the pillow body in a variety of ways. For example, the pillow body may include a pocket into which the support member is inserted. The pocket may be an integral part of the cover or a separately attached pocket or sleeve. A variety of fasteners could be used to close the pocket or sleeve, such as a zipper, buttons, snaps, clips, ties, a hook and loop fastener material, and the like. As another example, the support member could be attached using discrete fasteners, such as by a hook and loop fastener material, snaps, buttons, clips, a zipper, ties, buckles and the like. Further, in some cases, the support member may be positioned atop the pillow without using any fasteners.

Another way to removably attach the support member to the pillow body is by using a separate slipcover that slips over the pillow body. The support member may be integrally attached to the slipcover or removably attached, such as within a sleeve or pocket of the slipcover. The slipcover could fully envelop the pillow body, or could slip over only a portion, such as the top surface in a manner similar to a mattress cover.

One particular advantage of using a separate support member is that it may be engineered to have a size, shape and/or firmness that is different from the rest of the pillow. This may be accomplished by using materials that can be shaped and/or contoured more easily than using a traditional fiber fill material. Examples of materials that can be used for the purpose include open cell foams, closed cell foams, visco-elastic materials, gels, inflatable bladders and the like. The support member can be made using a molding process or a self-skinning foam process.

The removable support member may have an outer shape that is somewhat similar to the top surface of the pillow body. In some cases, the support member could be slightly smaller, especially along the arms (or may include no arms at all). This reduced size helps when inserting the support member into a pocket.

The support member may also be inclined from a distal side (away from the user) to a proximal side (adjacent the user). In other words, a top surface of the support member may angle downward toward the user. This positions the baby somewhat on her side when laying lengthwise across the pillow, thus helping to position the baby's mouth near the mother's breast when nursing and keep the baby from rolling away from the mother. The angle of decline may be in the range of about 20 degrees to about 35 degrees off horizontal. While defined in terms of an "angle", it will be appreciated that the top surface of the support member may not be flat or planar and the "angle" has reference to the height at the distal side relative to the proximal side.

For example, in some cases one or more of the surfaces of the support member could be shaped or contoured. For instance, the top surface could be recessed relative to an outer edge to form a lip around at least a portion of the support member. This lip helps to hold the baby on the pillow and also assists in positioning the baby relative to the mother. Other shapes are also possible, such as a flat inclined surface. Further, the bottom surface could also be contoured so as to provide a friction surface to help secure the support member to the pillow body.

The firmness of the support, member may be defined relative to the pillow body, such as 2 or 3 times as firm, or in terms of a specific firmness or density. Also, in some cases, the support member itself could have layers/sections with different firmnesses and/or constructed of different materials. Further, the support member could be constructed of multiple components and/or layers. For example, the support member could be constructed of a relatively firm base layer and a top layer of a less firm material or vice versa. Or, the center portion could be less firm while the ends are more firm. Also, different support members may be included in a kit or sold separately so that the top surface of the pillow can be customized by the user. This allows the pillow to be used in a wide variety of applications. For example, different support members could be used for different sized babies, different sized mothers or other users. Also, such support members could be used to configure the pillow to be used for bottle feeding, simply holding the baby, or for non-baby uses, such as holding a book or other object.

Figure 2:
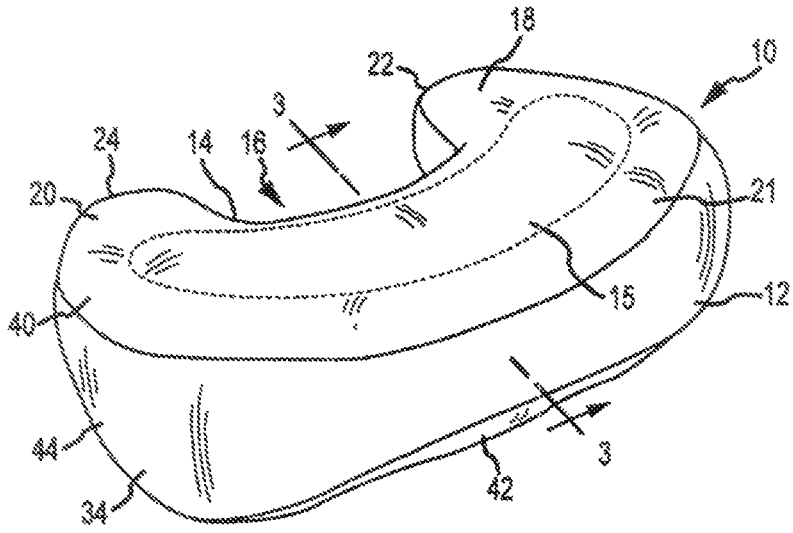
FIG. 2 is a top perspective view of the pillow of FIG. 1.
Figure 3:
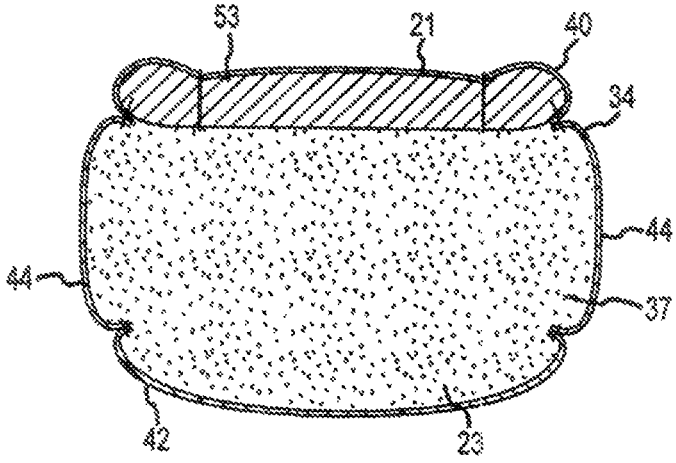
FIG. 3 is a cross sectional view of the pillow of FIG. 2 taken along lines 3-3.

Referring now to FIG. 1, one embodiment of a feeding pillow 10 will be described. As shown, pillow 10 is resting on the lap of a user while a baby rests on top of the pillow. As also shown in FIGS. 2 and 3, feeding pillow 10 may be constructed to have a generally U or C shape. In some cases, pillow 10 may also have an overall shape and feel that are similar to the support pillows described in U.S. Pat. Nos. 5,261,134, 5,661,861, 5,546,620 and 6,055,687; 6,685,024; 6,434,770; 6,671,908; 7,017,212; 6,279,185; 6,412,128; 7,451,508; 7,127,760; 6,944,898; 7,587,773; 7,472,443; 7,404,222; 7,430,774; 7,832,036; 7,788,752; 6,038,720; 6,763,539, incorporated herein by reference. However, the invention is not intended to be limited to only such pillows, but may be used with essentially any type of pillow having two arms that are joined by a medial region.

Feeding pillow 10 includes a somewhat curved outer surface or periphery 12 which is rounded. Pillow 10 further includes a somewhat curved central inner surface or periphery 14 which defines a well region 16. While the body of the pillow 10 is substantially continuous and uniform, with curved surfaces 12 and 14 also being continuous, it is convenient to consider the pillow body as having a medial region 15 and two arms 18 and 20. The arms 18 and 20 extend somewhat perpendicularly away from the medial region 15, but are slightly curved out from the outer periphery to give the pillow 10 its overall curved configuration. While the continuous structure does not provide a precise or exact division between the medial region 15 and each arm, considering the body of the pillow in view of these components facilitates a description of the structure and function of the pillow 10.

Arms 18 and 20 include respective ends 22 and 24, positioned remotely of the medial region 15. Pillow 10 is proportioned so that ends 22 and 24 can easily fit around the sides of an adult's torso or waist. Pillow 10 has a bilateral symmetry with respect to a central plane which passes vertically through medial region 15. Pillow 10 is also symmetrical about a mid-plane which horizontally bisects the pillow body. In some cases, it may be convenient to refer to a center line which horizontally lies along and bisects the pillow. Further, pillow 10 includes a top surface 21 and a bottom surface 23, with top surface 21 designed to support a baby while bottom surface 23 is designed to rest on a user's lap. As described herein, top surface 21 could in some cases be placed face down on the user's lap while bottom surface 23 is placed faced up and used to hold the baby.

Well region 16 has a width that is selected to permit the support pillow to reach around the torso or waist of most users. The pillow 10 is also constructed so that the arms 18 and 20 may be moved away from each other to vary the width so that the pillow 10 may be used in a variety of applications, including larger sized adults.

Pillow 10 includes a central core which may be constructed of a fill material 37 such as a hypoallergenic polyester filling. The central core is encased by a cover 34. The majority of cover 34 is constructed of a material that is compliant while generally not stretchable. Examples of such fabrics include cotton, polyesters, cotton/poly blends, or other pliant conforming fabrics. The fill material is firmly and tightly packed into cover 34, such that the core and cover 34 together provide a self-supporting pillow body, i.e., the support pillow 10 retains its shape without any sagging or drooping of arms 18 and 20 when held at the medial region 15. The tightly packed fill material forming core also provides the pillow with firmness in the sense that it will undergo only slight elastic deformation (as compared to a conventional pillow) when the pillow rests on an object (such as a person's legs). Other fill materials that could be used include natural or synthetic fibers, synthetic beads, feathers, foam, and organic granular fill materials such as husks and seeds and the like.

In the embodiments shown, cover 34 is formed of multiple pieces of fabric, it being appreciated that cover 34 could be constructed in other ways as well. For convenience of discussion, cover 34 can be described in terms of three major components: a top piece 40 (which forms a top surface), a bottom piece 42 (which forms a bottom surface), and a center panel 44. Examples of materials that may be used for top piece 40 and bottom piece 42 include cotton fabrics, polyester fabrics, cotton/poly blends and the like. By using such materials for the top piece 40 and bottom piece 42, various conventional fabrics may be used to provide a comfortable, decorative and aesthetically pleasing surface. Although shown with top piece 40 and bottom piece 42, it will be appreciated that a single piece of fabric or multiple pieces may be used to cover the top and bottom of the pillow. Sewn to top piece 40 and bottom piece 42 is center panel 44. In this way, center panel 44 surrounds the inner well 16 and the outer periphery and eliminates a seam running along the mid-plane. Although the pieces may be sewn together, other techniques may also be used, such as by using glue, lacing, staples, snaps and the like. The configuration the center panel 44 makes the pillow sufficiently resilient to spring arms 18 and 20 back to their original shape.

As best shown in FIG. 3, positioned above fill material 37 is a stiffening layer 53 that is positioned near top surface 21 while the fill material 37 extends to the bottom surface 23. Stiffening layer 53 is designed such that top surface 21 is more firm (i.e., will undergo less deformation when a force is applied) than bottom surface 23. This provides comfort to the user while ensuring the extra support is provided to the baby, particularly when feeding.

Stiffening layer 53 will typically be coextensive with top surface 21 and thus extend along medial region 15 as well as ends 18 and 20. Stiffening layer 53 may be constructed of a dense foam, such as a polyurethane foam with a high IFD, or Indentation Force Deflection. The acronym IFD refers to the hardness or softness of the foam. For example, the higher the IFD, the firmer the foam. IFD is defined as the amount of force, in pounds, required to indent a fifty square inch, round indentor foot into a predefined foam specimen a certain percentage of the specimen's total thickness. IFD is specified as the number of pounds at a specific deflection percentage on a specific height foam sample, e.g., 25 pounds per 50 square inches at a 25% deflection on a four inch thick piece.

In some embodiments, the IFD may be at least 20, and in some cases greater than about 30 and in other cases in the range from about 30 to about 45.

Stiffening layer 53 may also have a thickness in the range from about 0.5 inch to about 3 inches. Also, in some cases, multiple foam pieces or other stiffening materials could be stacked on each other to form layer 53.

To facilitate construction, stiffening layer 53 may be sewn or otherwise attached to top piece 40. Further, various stitching patterns in top piece 40 may be employed.

Figure 4:
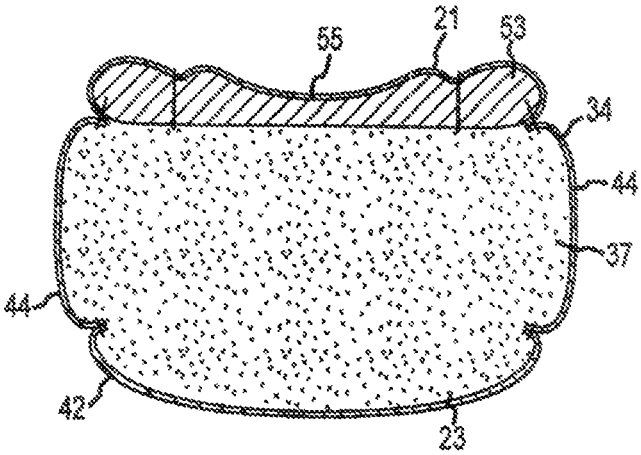
FIG. 4 is a cross sectional view of an alternative embodiment of a feeding pillow.
Figure 5:
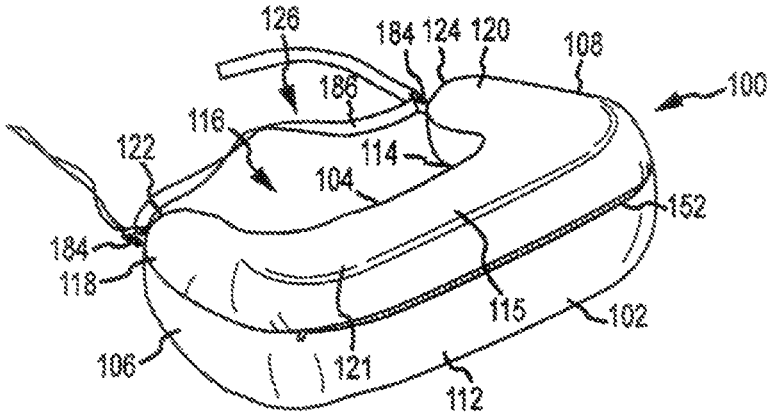
FIG. 5 is perspective view of another embodiment of a feeding pillow according to the invention.
Figure 6:
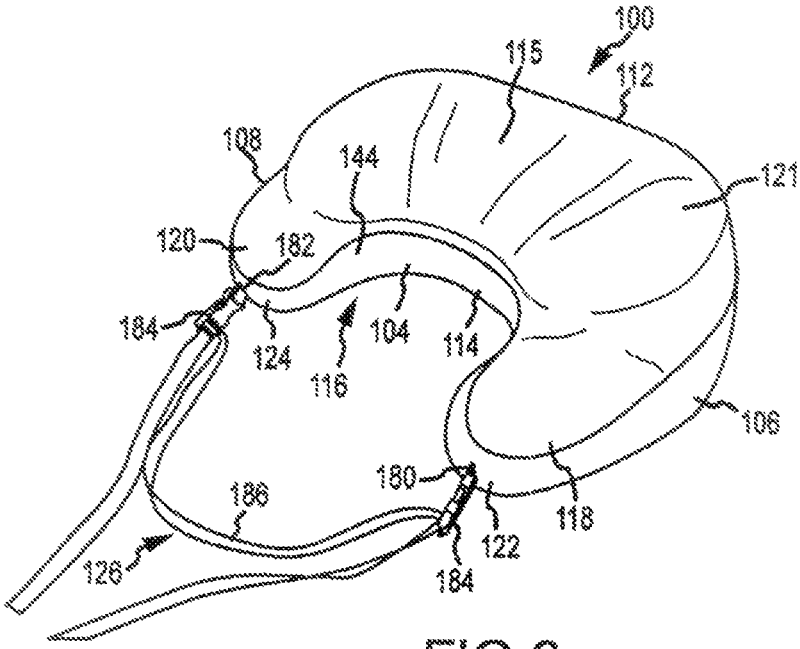
FIG. 6 is another perspective view of the feeding pillow of FIG. 5.
Figure 7:
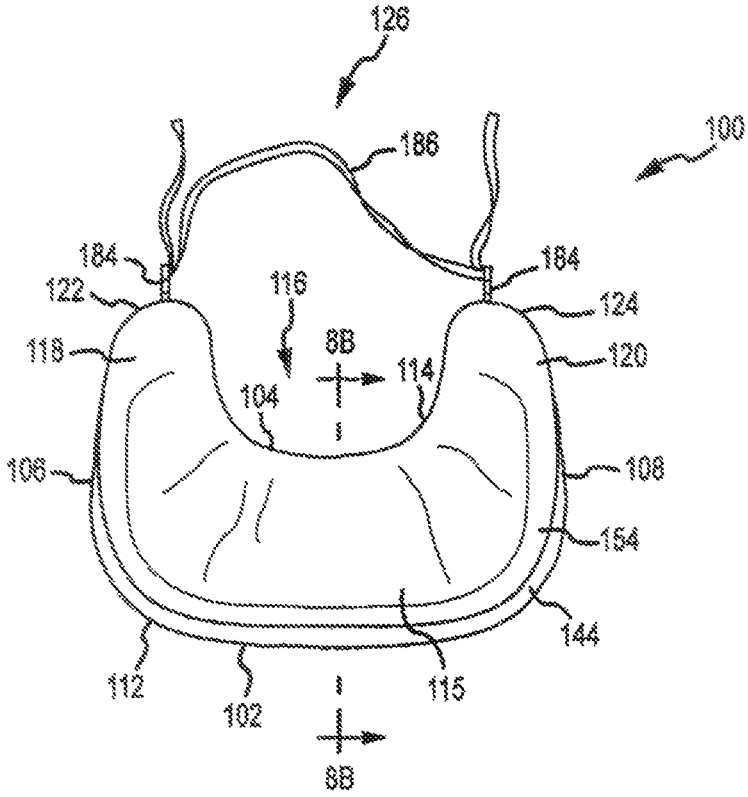
FIG. 7 is a top view of the pillow of FIG. 5.

As shown in FIG. 4, in some eases stiffening layer 53 may be surface modified to have a variety of shapes. For example, a recess 55 may be provided to form a recessed region in top surface 21. The recess provides a region in which the baby may rest when placed onto top surface 21.

Although shown integrated into pillow 10, it will be appreciated that stiffening layer 53 could be removably attached to pillow 10 so that it could be removed when needed. For example, cover 34 could include a sleeve or pocket into which stiffening layer 53 is inserted. The pocket could include one or more fastening mechanisms to secure stiffening layer 53 within the pocket. For example, the pocket could have a zipper that is used to close an opening through which stiffening layer 53 is inserted. Also, stiffening layer 53 may be sized, shaped or otherwise configured to be similar to any of the other inserts and/or stiffening members described herein.

Referring now to FIGS. 5-8B, another embodiment of a feeding pillow 100 will be described. For convenience of discussion, feeding pillow 100 may be defined in terms of a distal side 102, a proximal side 104, a lateral side 106 and another lateral side 108. Further, feeding pillow 100 may include an outer periphery 112 that is generally located at distal side 102 and an inner periphery 114 that is generally located at proximal side 104. As shown, pillow 100 has a generally U or C shape so that it may conveniently be placed about the stomach of an individual, typically an adult. While shown to have such a shape, it will be appreciated that pillow 100 may have other shapes, including any of the other embodiments described herein or the embodiments incorporated by reference. For example, feeding pillow 100 may be configured to have a similar outer geometry or periphery to that of feeding pillow 10 as previously described, or to any of the pillows described in the patents and applications previously incorporated by reference. To facilitate discussion, feeding pillow 100 may be defined in terms of a medial region 115 where an object, such as a baby, may be placed, as well as providing a support surface for resting the pillow, such as on a user's lap. Slightly extending from ends of medial region 115 are arms 118 and 120, each having an end 122 and 124, respectively. Further, feeding pillow 100 may include a top surface 121 where an object, such as a baby, is typically placed, and a bottom surface 123 where the pillow typically rests. However, it will be appreciated that top surface 121 and bottom surface 123 may be used for different applications, and the terms "top" and "bottom" are not necessarily limiting as to the particular orientation of feeding pillow 100. The outer periphery 112 is generally straight along distal side 102, then gently curves to form a rounded geometry with arms 118 and 120. Further, ends 122 and 124 may be rounded. Inner periphery 114 is also curved so as to be U or C shaped to define well region 116. Arms 118 and 120 extend somewhat perpendicularly away from medial region 115, so as to extend along a user's sides when pillow 100 is in use. Pillow 100 has a bilaterally symmetry with respect to a central plane which passes vertically through medial region 115. Well region 116 has a length (between arms 118 and 120) sufficient to permit pillow 100 to reach around the torso or waist of most users. Pillow 100 is also constructed so that arms 118 and 120 may be moved away from each other to vary the width of the pillow 100 so that it may be used in a variety of applications, including larger size adults and women who have recently given birth. As described in greater detail hereinafter, a belt 126 may optionally be used to hold feeding pillow 100 adjacent the user's stomach or torso when in use.

Figure 8A:
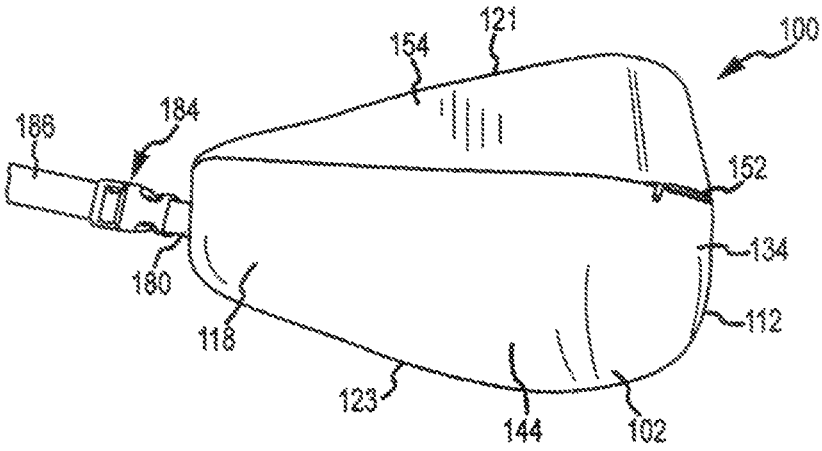
FIG. 8A is a side view of the pillow of FIG. 5.
Figure 8B:
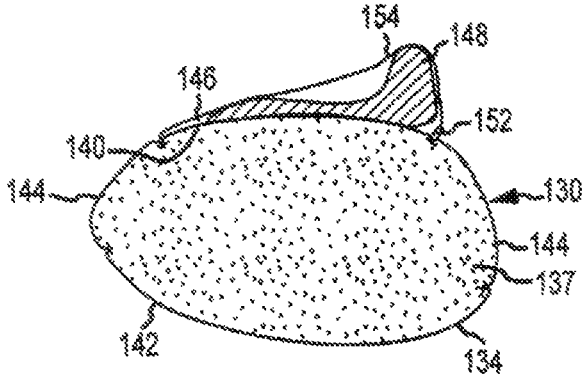
FIG. 8B is a cross-sectional side view of pillow of FIG. 7 taken along lines 8B-8B.
Figure 9:
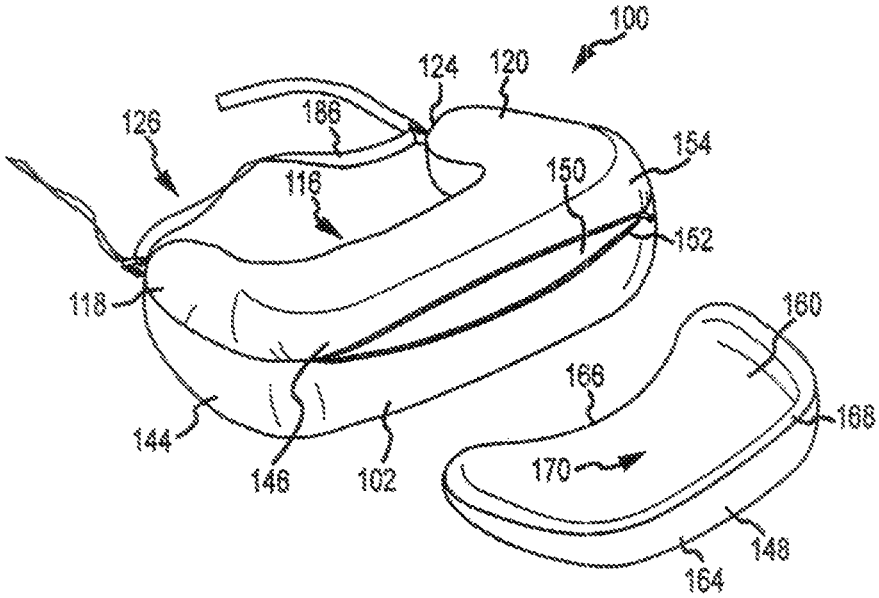
FIG. 9 illustrates the feeding pillow of FIG. 5 with a support member shown removed from the pillow.
Figure 10:
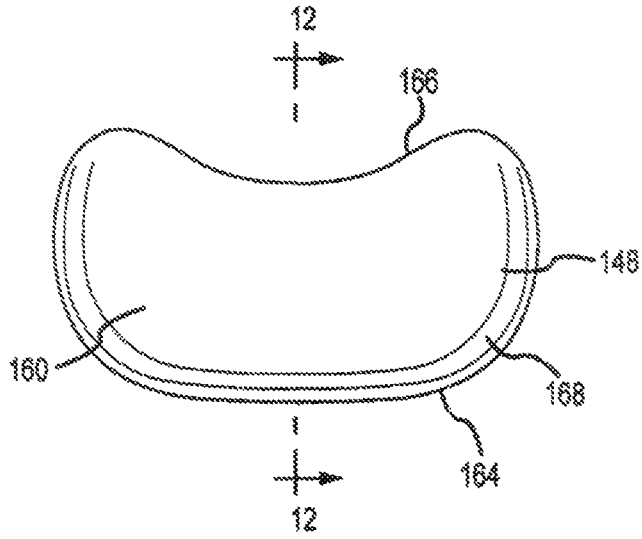
FIG. 10 is a top view of the support member of FIG. 9.
Figure 11:
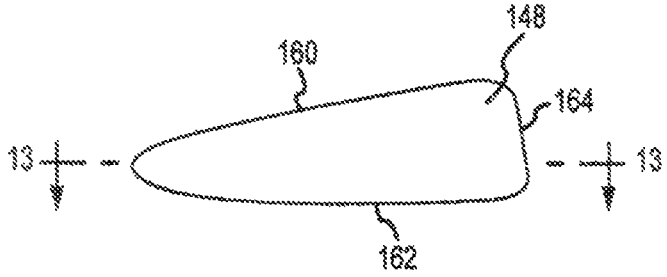
FIG. 11 is a side view of the support member of FIG. 9.
Figure 12:
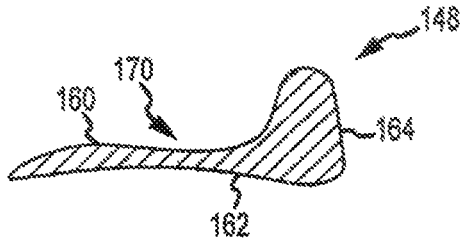
FIG. 12 is a cross-section side view of the support member of FIG. 10 taken along lines 12-12.
Figure 13:
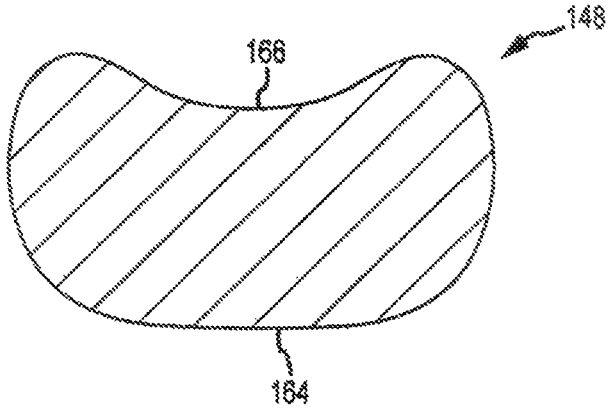
FIG. 13 is a cross-sectional view of the support member of FIG. 11 taken along lines 13-13.

As shown in FIG. 8B, feeding pillow 100 may be constructed of a pillow body 130 that is constructed of a fabric cover 134 that encases a fill material 137. The majority of cover 134 may be constructed of a material that is generally not stretchable. Examples of such fabrics include cotton, polyesters, cotton/poly blends, or other pliant conforming fabrics. The fill material 137 is thinly and tightly packed into cover 134, such that the core and cover 134 together provide a self-supporting pillow body. In other words, support pillow 100 would generally retain its shape without any sagging or drooping of arms 118 or 120 when held at the medial region 115. The tightly packed fill material forming the core also provides the pillow with firmness in the sense that it will undergo only slight elastic deformation when the pillow rests on an object, such as a person's legs. Other possible fill materials include natural or synthetic fibers, synthetic beads, feathers, foams, organic granular fill materials, such as husks and seeds, and the like.

Pillow body 130 may be formed in a variety of ways. In the embodiment shown, cover 134 is formed of multiple pieces of fabric that are sewn together. However, it will be appreciated that cover 134 may be constructed of various pieces of fabric that are sewn or otherwise connected together in ways other than those illustrated in the specific embodiments. For convenience of discussion, cover 134 may be described in terms of the following major components: a type piece 140 (which forms a top surface), a bottom piece 142 (which forms a bottom surface) and a side panel 144 which extends around the sides of pillow body 130. These various fabric pieces may be constructed using any of the fabrics described herein. By using such materials for top piece 140, bottom piece 142 and side panel 144, various conventional fabrics may be used to provide a comfortable, decorative and aesthetically pleasing surface. Importantly, by constructing pillow 100 in this manner, pillow body 130 may be washed using conventional techniques. For example, pillow body 130 may be placed in a conventional washing machine and washed in a gentle cycle. In this way, if pillow body 130 becomes soiled, it may be easily cleaned by simply using a washing machine.

Still referring to FIG. 8B, cover 134 may conveniently be constructing by sewing top piece 140 and bottom piece 142 to side panel 144. In some cases, top piece 140, bottom piece 142 and side panel 144 may in turn include multiple pieces of fabric that are sewn or otherwise coupled together. Although sewing is one preferred technique, other techniques may be used to couple the pieces of fabric together, such as by using glue, lacing, staples, snaps and the like. Fill material 137 may be placed within cover 134 by using a blowing machine that blows the fill material into the cover through an opening in one of the seams. Such a technique is generally described in U.S. Pat. No. 7,089,639 incorporated herein by reference.

Referring also now to FIGS. 9-13, feeding pillow 100 may also include a pocket 146 having an opening 150 through which a support member 148 may be inserted. Although opening 150 is shown along the distal side of pillow 100, it will be appreciated that other locations may also be used, such as at other locations along the outer or inner periphery, including along one of the arms or the well region, or even across the top surface of the pillow. Conveniently, a fastener, such as a zipper 152, may be used to close opening 150 once support member is inserted into pocket 146. Other types of fasteners that may be used include ties, clips, buttons, a hook and loop fastener material, and the like. Pocket 146 may be formed by sewing or otherwise coupling a second top piece of fabric to cover 134. For example, a second top piece of fabric 154 may be connected to cover 134 along the same seam as top piece 140. However, second top piece 154 may be larger so that it provides sufficient space within the resulting pocket to hold support member 148. The second top piece of fabric 154 may be constructed of a fabric similar to those described in connection with cover 134. One exemplary type of fabric that may be used is a plush/velvet fabric, often referred to as a "minky" fabric. Such a fabric may also be referred to as a velour or jersey fabric having a small amount of stretch. The slight stretchability of fabric used for top piece 154 is advantageous in that it may facilitate inserting support member 148 more easily into pocket 146 and allows the top cover to smoothly conform to the shape of the support member 148. Also, once support member 148 is secured within pocket 146, the stretchable nature of the fabric helps to hold support member 148 in place so that it does not move around within pocket 146 or shift relative to top surface 121 of feeding pillow 100. Although pocket 146 is shown constructed of a single piece of fabric, it will be appreciated that multiple pieces could be used, including those which are sewn or otherwise coupled to cover 134 at other locations. Further, multiple pockets of different sizes and/or shapes may be provided, with multiple support members that are inserted into the pockets.

One particular advantage of using a removable support member 148 is that support member 148 may be removed when not needed. This may occur for a variety of reasons. For example, support member 148 may be constructed of a material that is not suitable for a conventional washing machine. Hence, support member 148 may be removed from pocket 146 prior to placing feeding pillow 100 into a conventional washing machine. Also, different shapes, sizes, and firmnesses of support members may be interchanged within pocket 146. In this way, the shape and feel of top surface 121 may be varied simply by varying the type of support member 148 that is placed within pocket 146. Finally, in some cases feeding pillow 100 may be used without any type of support member 148. In this way, pocket 146 may be left empty while feeding pillow is in use. Still further, while support member 148 has been described as being able to be coupled to feeding pillow 100 using pocket 146, it will be appreciated that other techniques may be used. For example, a separate slip cover with or without a pocket may be placed over some or all of pillow body 130 to hold support member 148 to top surface 121. Other techniques for holding support member 148 to pillow body 130 include ties, clips, buttons, a hook and loop fastener material, and the like.

One particularly advantageous use of support member 148 is that it may be used to provide a more firm support surface for holding an object than is provided by pillow body 130. As previously described, pillow body 130 may be filled with a fill material 137 that is somewhat soft and pliable. In some cases, it may be desirable to have one of the surfaces, such as top surface 121, with a firmness that is different from pillow body 130. For example, support member 148 could be constructed of a material that is either more firm or less firm than the firmness provided by fill material 137. In many cases, it will be desirable to have support member 148 having a firmness that is greater than the firmness provided by pillow body 130. Such may be the case when feeding or nursing a baby where feeding pillow 110 rests upon a user's lap. Advantages of such a firmness are also described herein with reference to the embodiment of FIGS. 1-4. Accordingly, the firmness of support member 148 relative to pillow body 130 may be similar to that described in other embodiments.

Figure 14:
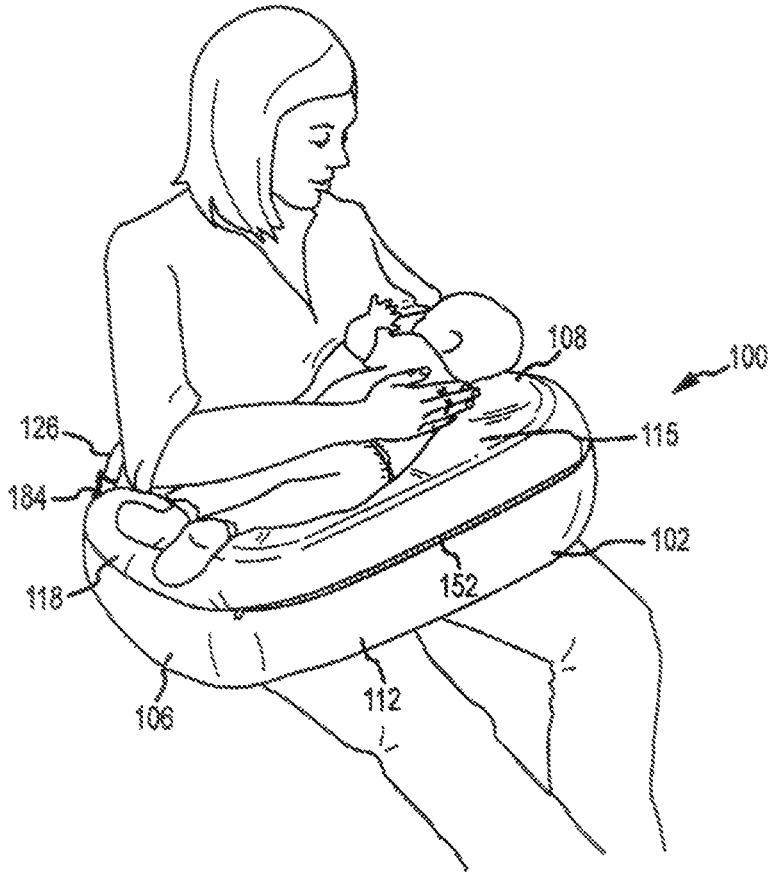
FIG. 14 illustrates the feeding pillow of FIG. 5 shown in use when nursing a baby.

Another particularly advantageous use of support member 148 is that it may be shaped to accommodate different uses. As shown in FIGS. 9-13, support member 148 has a particular shape that is advantageous in nursing a baby as illustrated in FIG. 14. Support member 148 may be defined in terms of a top 160, a bottom 162, an outer periphery 164 and an inner periphery 166. A lip 168 may be formed along outer periphery 164 by forming a recessed region 170. This particular configuration helps to position or orient the baby toward the mother's breast as illustrated in FIG. 14. In other words, lip 168 and recessed region 170 cooperate to help roll the baby somewhat on the baby's side so that the baby's face is generally positioned facing the mother's breast. Further, support member 148 may be sized to be slightly smaller than the top surface 121 of pillow 100, particularly along arms 118 and 120 so that the arms will not interfere with the baby's head or feet when feeding as illustrated in FIG. 14. However, it will be appreciated that in some cases, support member 148 may also include arms similar to arms 118 and 120 on feeding pillow 100.

The angling of the baby while feeding may be thought of in terms of providing top 160 of support member 148 with an angle of inclination. Although shown with a contoured top 160, this angle may be defined in terms of a straight line or plane extending from lip 168 to inner periphery 166. This angle is relative to bottom 162. The angle of inclination as just defined may be in the range from about 20 degrees to about 35 degrees, and in some cases about 25 degrees to about 33 degrees. This so-called "angle" is particularly critical in orienting the baby at the appropriate position to facilitate nursing. Such an orientation of the baby may be provided using other geometries, and not necessarily by using lip 168 and recessed region 170. For example, top 160 could be planar or may include other surface contours to help appropriately angle or position the baby. Further, bottom 162 could also include contours, such as being roughened or include scallops or other surface treatments to help adhere support member 148 to pillow body 130.

As previously described, support member 148 may be configured to be more firm than pillow body 130. This may be accomplished by constructing support member 148 out of a dense foam material, such as a polyurethane foam with a high IFD. The IFD may be similar to that described in connection with other embodiments. The polyurethane foam material may be open cell or closed cell and may therefore include a skin as is known in the art. Support member 148 may be formed using a molding process or may be surface modified using surface modification equipment as is known in the art. Other types of materials that may be used to form support member 148 include viscoelastic materials, gels, inflatable bladders, fill materials encased within fabrics, and the like.

Still referring to FIG. 14, when feeding pillow 100 is used as a nursing pillow, the overall dimensions of feeding pillow 100 and/or support member 148 may be important. For example, the length of medial region 115 (which may extend from lateral side 106 to 108) may be in the range from about 14 inches to about 26 inches, and in some cases from about 18 inches to about 24 inches. This provides a sufficient length to cover the user's lap while sitting and also provides a comfortable resting surface for babies having an age range from about newborn to about 12 months. The width of medial region 115 (which may extend from outer periphery 112 to inner periphery 114 along the center line of the pillow) may be in the range from about 6 inches to about 16 inches, and in some cases from about 7 inches to about 10 inches. This dimension also helps to provide a wide enough surface to hold both the baby and support member 148. Arms 118 and 120 may extend from medial region 115 in the range from about 6 inches to about 20 inches, and in some cases from about 12 inches to about 14.5 inches. Further, the width of arms 118 and 120 may be in the range from about 4 inches to about 8 inches, and in some cases from about 4.5 inches to about 7 inches. The width of well region 116 (as defined by the length between arms 118 and 120) may be in the range from about 7 inches to about 18 inches, and in some eases from about 8 inches to 12 inches. This dimension helps to insure that well region 116 is wide enough to fit most adults, and in particular women who have recently delivered a baby. As previously described, arms 118 and 120 may be somewhat flexible or pliable so that they may snugly fit around the sides or waist of the user, particularly when the user is in a sitting position.

Support member 148 may be sized to be slightly smaller in outer dimensions than pillow body 130 so that it may fit within pocket 146. In the embodiment shown in FIGS. 9-13, support member 148 may have a length (the largest distance from left to right in FIG. 13) in the range from about 15 inches to about 25 inches, and in some cases from about 18 inches to about 22 inches. The width at the medial region (which is perpendicular to the length dimension in FIG. 13) may be in the range from about 5 inches to about 15 inches, and in some cases from about 7 inches to about 10 inches. The height of support member 148 at lip 168 may be in the range from about 2 inches to about 5 inches, and in some cases from 2.5 inches to about 3.5 inches. The height at inner periphery 166 may be in the range from about 0.25 inches to about 2 inches, and in some cases from about 0.25 inches to about 1 inch. In some cases, the height at the inner periphery could approach 0 inches. This defines the so-called angle from lip 168 to inner periphery 166 along top 160 to be in the range from about 20 degrees to about 35 degrees, and in some cases near 30 degrees.

Support member 148 includes rounded edges that pass over arms 118 and 120 when support member 148 is within pocket 146. As such, support member 148 does not include arms in the sense that feeding pillow 100 includes arms. This configuration may be used to facilitate inserting of support member 148 into pocket 146. Also, the absence of any arms may also help to position or orient the baby when feeding as previously described.

Referring now to FIGS. 5, 6, 8A, 9 and 14, use of belt 126 will be described in greater detail. Belt 126 includes attachments 180 and 182 at arms 118 and 120, respectively. Attachments 180 and 182 may include fabric loops that are sewn to ends 122 and 124. Attachments 180 and 182 are each coupled to a two-piece buckle 184, where the two pieces clip together as is known in the art. The other piece of buckle 184 is connected to a single strap 186 that passes between the two buckles 184 so as to pass around the back of the user when in the sitting position. The length of strap 186 is adjustable by passing through openings in one end of the two-piece buckle 184 as is known in the art. To attach strap 186 to feeding pillow 100, one end of the two-piece buckle is simply inserted into the other end of the buckle until it snaps in place. The ends of strap 186 may be pulled or tugged in order to tighten or adjust belt 126. This tightening or adjustment may be done while belt 126 is secured to the user. Having a removable belt is advantageous in that it may be easily removed for applications not requiring a belt or simply in cases where the user does not wish to have a belt. Further, belt 126 may easily be removed when feeding pillow 100 is to be washed. Although described in terms of a buckle 184, it will be appreciated that other attachment mechanisms may be used, including snaps, ties, other clips, a hook and loop fastener material, and the like. Also, strap 186 may be configured to have various shapes and sizes according to a particular need. For example, strap 186 may include a wider back support section.

The invention has now been described in detail for purposes of clarity and understanding. However, it will be appreciated that certain changes and modifications may be made within the scope of the appended claims.

What is claimed is:

1. A feeding pillow, comprising:

a pillow body generally defined by a medial region and two opposing arms having ends that extend from the medial region, wherein the medial region comprises a far side and a near side that is opposite to the near side, wherein the near side is configured to be placed near or adjacent a user's stomach, with the arms generally near or adjacent the user's sides, wherein the pillow body has a top surface that is adapted to support a baby and a bottom surface that is adapted to be placed on the user's lap, wherein the pillow body comprises a fabric cover and a fill material disposed within the fabric cover, and wherein when the near side of the medial region of the pillow body is placed adjacent the user's stomach, the far side of the medial region faces away from the user's stomach;

a support member removably coupled to the pillow body at or above the top surface, wherein the support member has a firmness that is different from a firmness of the pillow body, wherein the support member has a far side and a near side, and wherein the far side of the support member is located generally at the far side of the medial region of the pillow body so as to be aligned with the far side of the medial region and the near side of the support member terminates short of the ends of the arms of the pillow body when the support member is coupled to the pillow body; and wherein termination of the support member short of the ends of the pillow body provides a support surface that helps to position or orient a baby when feeding by providing an angle of inclination that rotates the baby toward the user who is feeding the baby, allows the ends of the arms of the pillow body to be flexible so that they may snugly fit around the sides or waist of the user, and allows the support member to be more easily positioned with respect to the pillow body.

2. A pillow as in claim 1, wherein the firmness of the support member is greater than the firmness of the pillow body.

3. A pillow as in claim 1, wherein the support member covers a majority of the medial region at the top surface, and wherein the support member in regions of the arms of the pillow body includes rounded corners that terminate short of the ends of the arms of the pillow body.

4. A pillow as in claim 1, wherein the support member has a top surface, a bottom surface, a distal side and a proximal side, and where the top surface generally angles downward from the distal side to the proximal side.

5. A pillow as in claim 1, further comprising a pocket at the top surface of the pillow body, wherein the pocket defines an enclosure into which the support member is removably received.

6. A pillow as in claim 5, wherein the pocket is sewn about an outer periphery of the pillow body.

7. A pillow as in claim 6, wherein the pocket defines an opening, and further comprising a zipper to close the opening.

8. A pillow as in claim 1, wherein the medial region of the pillow body has a length in the range from about 14 inches to about 26 inches, a width in the range from about 6 inches to about 16 inches, and wherein each of the arms has a length in the range from about 6 inches to about 20 inches, and a width in the range from about 4 inches to about 8 inches to define a stomach receiving region with a width of about 7 inches to about 18 inches.

9. A pillow as in claim 4, wherein the support member has a length in the range from about 15 inches to about 25 inches, a width in the range from about 5 inches to about 25 inches, a height at the distal side in the range from about 2 inches to about 5 inches, and a height at the proximal side in the range from about 0.25 inches to about 2 inches to define an angle of inclination in the range from about 20 degrees to about 35 degrees.

10. A pillow as in claim 1, wherein the support member further comprises reduced sized arms at the near side of the support member that are shorter than the arms of the pillow body.

11. A pillow as in claim 1, further comprising a belt removably attached to the arms.

12. A pillow as in claim 11, further comprising a pair of buckle clips to removably attach the belt to the pillow body.

13. A pillow as in claim 1, wherein the support member comprises a contoured upper surface so as to define an elevated distal edge and a recessed center region.

14. A pillow as in claim 1, wherein the support member is constructed from a material selected from a group consisting of an open cell foam, a closed cell foam, a gel material, a visco-elastic material, and an inflatable bladder.

15. A feeding pillow, comprising:

a pillow body generally defined by a medial region and two opposing arms that extend from the medial region, wherein the medial region comprises a far side and a near side that is opposite to the near side, wherein the near side is configured to be placed near or adjacent a user's stomach, with the arms generally near or adjacent the user's sides, wherein the pillow body has a top surface that is adapted to support a baby and a bottom surface that is adapted to be placed on the user's lap, wherein the pillow body comprises a fabric cover and a fill material disposed within the fabric cover, and wherein when the near side of the medial region of the pillow body is placed adjacent the user's stomach, the far side of the medial region faces away from the user's stomach;

a support member removably coupled to the pillow body at or above the top surface, wherein the support member has a distal side and a proximal side, wherein the support member is removably coupled to the pillow body such that the far side of the medial region is generally aligned with the distal side of the support member, wherein the support member covers a majority of the medial region at the top surface while the proximal side terminates short of ends of the arms so as to not cover a majority of the arms of the pillow body to define uncovered arm portions of the pillow body, and angles downward from the distal side to the proximal side; and wherein the uncovered arm portions of the pillow body in combination with the support member provide a support surface that helps to position or orient a baby when feeding by providing an angle of inclination that rotates the baby toward the user who is feeding the baby, allows the uncovered arm portions of the pillow body to be flexible so that they may snugly fit around the sides or waist of the user, and allows the support member to be more easily positioned with respect to the pillow body.

16. A pillow as in claim 15, wherein the support member covers substantially all of the medial region at the top surface.

17. A pillow body generally defined by a medial region and two opposing arms having ends that extend from the medial region, wherein the medial region comprises a far side and a near side that is opposite to the near side, wherein the near side is configured to be placed near or adjacent a user's stomach, with the arms generally near or adjacent the user's sides, wherein the pillow body has a top surface that is adapted to support a baby and a bottom surface that is adapted to be placed on the user's lap, wherein when the near side of the medial region of the pillow body is placed adjacent the user's stomach, the far side of the medial region faces away from the user's stomach, wherein the pillow body comprises a fabric cover and a fill material disposed within the fabric cover, wherein the medial region of the pillow body has a length in the range from about 14 inches to about 26 inches, a width in the range from about 6 inches to about 16 inches, and wherein each of the arms has a length in the range from about 6 inches to about 20 inches;

a support member removably coupled to the pillow body at or above the top surface, wherein the support member has a firmness that is different from a firmness of the pillow body, wherein the support member has a length in the range from about 15 inches to about 25 inches, and a width in the range from about 5 inches to about 15 inches such that the support member terminates short of the ends of the arms of the pillow when the support member is coupled to the pillow body, wherein the support member has a far side and a near side, and wherein the far side of the support member is located generally at the far side of the medial region of the pillow body so as to be aligned with the far side of the medial region and the near side of the support member terminates short of the ends of the arms of the pillow; and wherein termination of the support member short of the ends of the pillow body provides a support surface that helps to position or orient a baby when feeding by providing an angle of inclination that rotates the baby toward the user who is feeding the baby, allows the ends of the arms of the pillow body to be flexible so that they may snugly fit around the sides or waist of the user, and allows the support member to be more easily positioned with respect to the pillow body.

18. A pillow as in claim 17, wherein the support member terminates short of ends of the arms of the pillow by a distance in the range from about 7 inches to about 21 inches.

* * * * *